US009169042B2

(12) United States Patent
Guelkner et al.

(10) Patent No.: US 9,169,042 B2
(45) Date of Patent: Oct. 27, 2015

(54) ENERGY ABSORBING CONTAINER

(75) Inventors: Benjamin Richard Guelkner, Pocatello, ID (US); Robert Brett Holben, Roswell, GA (US); Robert Burton Brownell, Jr., Decatur, GA (US); Russell Joseph Kroll, Atlanta, GA (US); Suzuko Hisata, Atlanta, GA (US); Steven Craig Vandeberg, Suwanee, GA (US); Kirk William Charles, Austell, GA (US); Angus Donald Ross McLeod, Hamilton (NZ)

(73) Assignee: MERIAL, INC., Duluth, GA (US)

( * ) Notice: Subject to any disclaimer, the term of this patent is extended or adjusted under 35 U.S.C. 154(b) by 130 days.

(21) Appl. No.: 12/849,611

(22) Filed: Aug. 3, 2010

(65) Prior Publication Data

US 2011/0174659 A1 Jul. 21, 2011

Related U.S. Application Data

(63) Continuation of application No. 12/640,241, filed on Dec. 17, 2009, now abandoned, which is a continuation-in-part of application No. 11/635,838, filed on Dec. 8, 2006, now abandoned.

(60) Provisional application No. 60/748,374, filed on Dec. 8, 2005.

(51) Int. Cl.
*B65D 85/00* (2006.01)
*B65D 23/08* (2006.01)

(52) U.S. Cl.
CPC ..... *B65D 23/0885* (2013.01)

(58) Field of Classification Search
CPC ..... B65D 5/58
USPC ..... 206/521, 446, 592, 591, 594, 438, 586, 206/433; 215/12.1, 13.1, 11.3, 10, 393, 215/394, DIG. 3, 395, 399; 220/742, 23.89, 220/920, 23.87, 737, 740, 741, 743, 670, 220/671, 672, 673, 739; 604/415; 141/329
See application file for complete search history.

(56) References Cited

U.S. PATENT DOCUMENTS

| | | | | | |
|---|---|---|---|---|---|
| 3,155,260 | A | * | 11/1964 | Widener | 215/12.1 |
| 4,022,343 | A | * | 5/1977 | Richardson | 206/521 |
| 4,245,685 | A | * | 1/1981 | Nemitz et al. | 220/780 |
| 4,408,698 | A | * | 10/1983 | Ballester | 220/790 |
| 4,813,541 | A | * | 3/1989 | Velasco et al. | 206/459.1 |
| 5,190,151 | A | * | 3/1993 | Dietterich | 206/214 |
| 5,590,782 | A | * | 1/1997 | Haber et al. | 206/528 |
| 5,833,197 | A | * | 11/1998 | Peabody | 248/346.01 |
| 5,904,267 | A | * | 5/1999 | Thompson | 220/592.16 |
| 6,568,434 | B2 | * | 5/2003 | Zinger | 141/2 |
| 6,793,076 | B1 | * | 9/2004 | Luo et al. | 206/521 |
| 6,983,843 | B2 | * | 1/2006 | Van Geert et al. | 206/438 |
| 2004/0129596 | A1 | * | 7/2004 | Geert et al. | 206/521 |
| 2005/0279665 | A1 | * | 12/2005 | Lo | 206/446 |

* cited by examiner

*Primary Examiner* — Jacob K Ackun
*Assistant Examiner* — Jenine Pagan
(74) *Attorney, Agent, or Firm* — Judy Jarecki-Black; Chad Kitchen; Merial, Inc.

(57) ABSTRACT

An embodiment of an energy absorbing container may include a shell formed of a plastic material, one or more energy absorbing components for absorbing energy resulting from impact loads, and an opening mechanism for opening the container and allowing the placement or removal of a bottle therefrom. The energy absorbing components securing a bottle stored within the container to may inhibit or prevent movement of the bottle within the container.

15 Claims, 20 Drawing Sheets

ENERGY ABSORBING CONTAINER

CROSS REFERENCE TO RELATED APPLICATIONS

This application is a continuation of U.S. application Ser. No. 12/640,241, filed Dec. 17, 2009 now abandoned, which is a continuation-in-part of U.S. application Ser. No. 11/635,838, filed Dec. 8, 2006 now abandoned, which claims priority to US provisional application 60/748,374, filed Dec. 8, 2005, both applications are herein incorporated by reference.

FIELD OF THE INVENTION

The present invention is directed to a new and useful apparatus for storing and dispensing liquid and solid agents. Specifically, the present invention is directed to an apparatus for storing and dispensing liquids via a multiuse injection system, wherein the container is designed to resist breaking if dropped.

BACKGROUND OF THE INVENTION

When dosing a large number of animals in a short period of time, for example in a single veterinary visit to a beef feed lot or to a chicken farm, a veterinarian or animal husbandry worker will often use a dosing gun injector. The dosing gun injector allows the user to dose a large number of animals without having to carry a large number of single dose vials. One such one such dosing gun injector is shown in FIG. 1.

The dosing gun injector has a needle in the cap, which is screwed on to the neck of a large vial of vaccine or other treatment to be injected into the animals. The needle in the cap punctures a seal on the container that prevents contamination of the vaccine. The vial is typically turned upside down in order to prevent any air in the vial or dosing gun from being injected into the animals. The vaccine or other treatment is typically injected by depressing some triggering device. As shown in the example of FIG. 1, the two parts of the handle are compressed together, thus pumping a predetermined and metered portion of the treatment through the dosing gun injector.

Traditionally, vaccines and other treatments are stored in glass vials. As can be readily appreciated, glass, though having the beneficial effect of typically not reacting with the material it contains, is relatively hard and readily breakable. Large vials, of the type commonly used with dosing gun injectors, are approximately the size and shape of the bottles shown in FIG. 1A, and generally contain either 500 ml or 250 ml of the treatment. Because this is sufficient vaccine or treatment for dosing a large number of animals, the accidental breakage of such a container can be very costly.

However, despite its breakability, glass remains one of the most common materials for storage of vaccines and other animal treatments. One benefit of glass is that it is not reactive with most treatments, as some plastics can be. Another reason glass continues to be used are the manufacturing costs involved in switching to other materials. Further, because many vaccines are live cultures, they can only properly be stored in sterile containers. As a result of the heat typically necessary for sterilization, glass remains a common choice for storage of vaccines and other animal treatments.

Due to the breakability of glass, attempts have been made to manufacture a shield or protective cover in which to place a glass bottle and prevent its breakage. One example of such a bottle can be seen in FIG. 2, where a protective cover for the drug MICOTIL is shown. The cover or sleeve in which the glass container is placed is formed of polypropylene and has flanges on both the top and bottom of the sleeve. When impacted, the flanges help distribute and reduce bottle stresses. The bottle is supported in the sleeve at both ends to prevent its movement within the sleeve. However, experience has shown that the approach evidenced by the MICOTIL protective cover has not proven to be wholly effective in preventing the breakage of bottles stored therein. In particular, this device fails when subjected to localized impacts which are concentrated in a small area. For example, the device shown in FIG. 2 will fail if a stress is imparted to the cover of the device at some point between the two flanges.

Accordingly, the present invention is directed to addressing these problems associated with existing containers.

SUMMARY OF THE INVENTION

It is an object of the present invention to provide an apparatus having a container that protects a glass bottle from accidental breakage.

An embodiment may include a container capable of inhibiting and/or preventing the breakage of a glass bottle stored therein when dropped on a concrete or similarly rigid surface.

In an embodiment, the container may be effective in inhibiting and/or preventing the breakage of a glass bottle stored within the container when the container is dropped against a hard edge surface impacting a side wall, a top wall, a bottom wall, any edge, or any surface of the container.

Some embodiments of the container may be effective in preventing the breakage of a glass bottle stored within the container when dropped from a height of about 36" (90 cm).

In another embodiment, a container may be effective in preventing the breakage of a glass bottle stored within the container, when the container is dropped from a height of up to about 60".

In some embodiments, the container may be effective when hung upside down.

An embodiment of the container may allow the use of both a standard syringe and a dosing gun injector to draw liquid product from the glass bottle.

In some embodiments, it may be an objective to provide a container, which incorporates a combination of the above-mentioned features in a cost-effective manner.

In an embodiment, an energy absorbing container may include a shell formed of a plastic material, one or more energy absorbing means for absorbing energy resulting from impact loads, the energy absorbing components securing a bottle stored within the container to prevent movement of the bottle within the container, and/or an opening mechanism for opening the container and allowing the placement or removal of a bottle therefrom.

In some embodiments, the energy absorbing means may isolate the bottle from an inner surface of said shell.

Some embodiments of the energy absorbing means may include, but is not limited to pliant fingers, tabs, petals, ribs, foam disks or any geometry capable of securing and preventing the breakage of a bottle contained therein.

An embodiment of the energy absorbing container may include a void for attachment of a dosing gun injector to the bottle.

In an embodiment, the energy absorbing container may include a shell that extends past the length of the bottle.

Some embodiments of the energy absorbing container may be clear enough to allow a bottle label or other content or descriptive markings to be read through the container.

In an embodiment, the energy absorbing container may include a shell that is formed of two parts, and these parts may be coupled using coupling means including, but not limited to snap fittings, slide locking mechanisms, threading, combinations of threading plus slide locking mechanisms, a flush joint, other coupling means known in the art and/or combinations thereof.

In an embodiment, the energy absorbing container may include three parts: a top part, a bottom part, and a cylindrical lens. The various parts may be coupled using a slide locking mechanism, or also with any other appropriate means for connecting or coupling as disclosed herein, or appropriate equivalents thereof known in the art.

In some embodiments, the energy absorbing container may include one or more energy absorbing means made of foam disks which surround the bottle. The foam disks may isolate the bottle from an inner surface of the shell. The foam disks may be held in place by supports which may be connected to the energy absorbing container.

In an embodiment, the energy absorbing container may include a shell formed of a single piece having a hinge. The hinge may allow the shell to protectively secure a bottle. In some embodiments, the shell may have a locking means and/or connecting means to restrict the movement of the hinge, thus preventing unwanted release of the bottle from the energy absorbing container.

In some of embodiments, the energy absorbing means may be positioned on a top and bottom end of a container separated by a cylindrical lens.

An embodiment of an energy absorbing container may include energy absorbing means formed of elastomeric, foam bumpers, and/or cushions isolating the bottle from the shell. In some embodiments, the energy absorbing container may include a removable base. An embodiment of an energy absorbing container may include an anti-rolling feature.

In some embodiments, the energy absorbing means may be ribs formed within the shell. The ribs may be in positioned in the top portion, the bottom portion, or both the top and bottom portions of the shell. In an embodiment, the ribs may isolate the bottle from the shell.

Some embodiments of the energy absorbing container may include a cover.

An embodiment of an energy absorbing container may include energy absorbing means formed of a bellows within the container. The bellows may be in both a top portion of the container and in a bottom portion of the container. The bellows may isolate a bottle from an inner surface of the shell.

In some embodiments, the energy absorbing container may also include bell shaped extensions. The bell shaped extensions may have slots machined and a hanger. The hanger may incorporate a lock.

In an embodiment, a method of dispensing a fluid from a dosing gun injector may include providing an energy absorbing container having a shell formed of a plastic material, one or more energy absorbing means for absorbing energy resulting from impact loads the energy absorbing means securing a bottle stored within the container to inhibit or prevent movement of the bottle within the container, and an opening means for opening the container and allowing the placement or removal of a bottle therefrom. In some embodiments, the method may also includes attaching the energy absorbing container, having a bottle placed therein to a dosing gun injector, and depressing a trigger located on said dosing gun thereby dispensing fluid contained within said bottle from said dosing gun injector.

In some embodiments, a method for protecting a bottle employed with a dosing gun injector may include providing an energy absorbing container having a shell formed of a plastic material, one or more energy absorbing means for absorbing energy resulting from impact loads, the energy absorbing means securing a bottle stored within the container to inhibit or prevent movement of the bottle within the container, and an opening means for opening the container and allowing the placement or removal of a bottle therefrom. In an embodiment, the method may also include inserting a bottle in the energy absorbing container, and attaching the energy absorbing container, having a bottle placed therein to a dosing gun injector.

These and other embodiments are disclosed or will be obvious from and encompassed by, the following Detailed Description.

BRIEF DESCRIPTION OF THE DRAWINGS

The following Detailed Description, given to describe the invention by way of example, but not intended to limit the invention to specific embodiments described, may be understood in conjunction with the accompanying Figures, incorporated herein by reference, in which.

DETAILED DESCRIPTION

An embodiment of an energy absorbing container may include a shell. Materials utilized in the shell may include, but are not limited to plastics such as, acrylic, polyethylene terephthalate (PET), polyvinyl chloride (PVC), polypropylene (PP), ABS plastics, Nylon, polybutylene terephthalate (PBT), polyethylene, such as High Density Polyethylene (HDPE), High Impact Polypropylene (HIPP), polycarbonate, polystyrene such as high impact polystyrene (HIP), thermoplastic olefins (TPO's), polyesters, polyurethanes (PU), polyamides, multipolymer compounds, composites, any material known in the art and/or combinations thereof.

Figures 3, 3A:
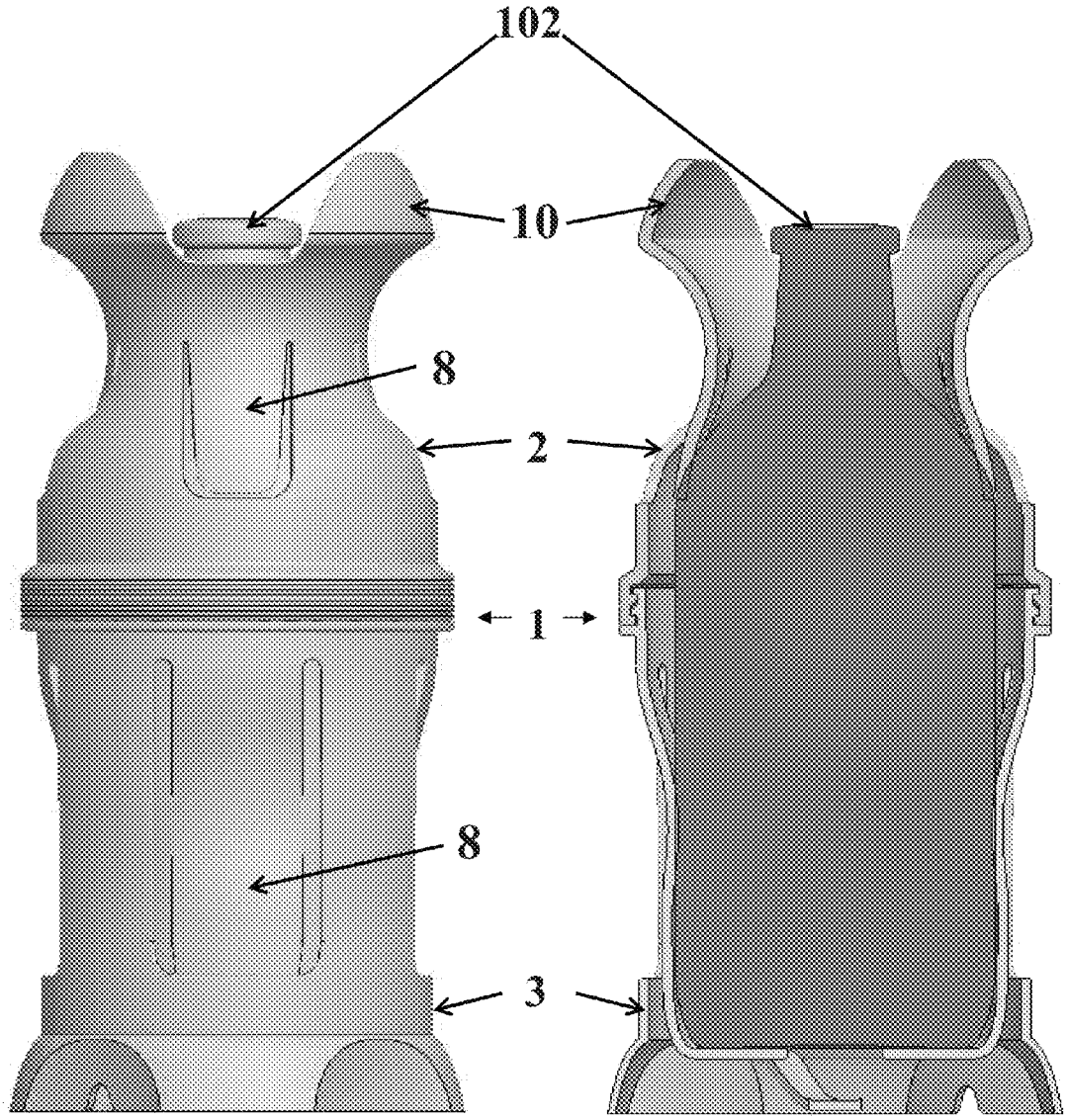
FIG. 3 is a profile view of an embodiment of a container, with a glass bottle contained therein.
FIG. 3A is a longitudinal cross-sectional view of an embodiment of a container, with a glass bottle contained therein.

In an embodiment, an energy absorbing container may include a shell having multiple portions. For example, as shown in FIGS. 3 & 3A, an energy absorbing container may include shell 1 having portion 2 and portion 3 designed to secure and protect bottle 102. Some embodiments may include two or more portions forming the shell of the energy absorbing container. In an embodiment, portions of the shell may be formed from one material. Some embodiments may include portions formed from different materials. An embodiment of the energy absorbing container may include a shell where each portion is formed from multiple materials.

Figure 4:
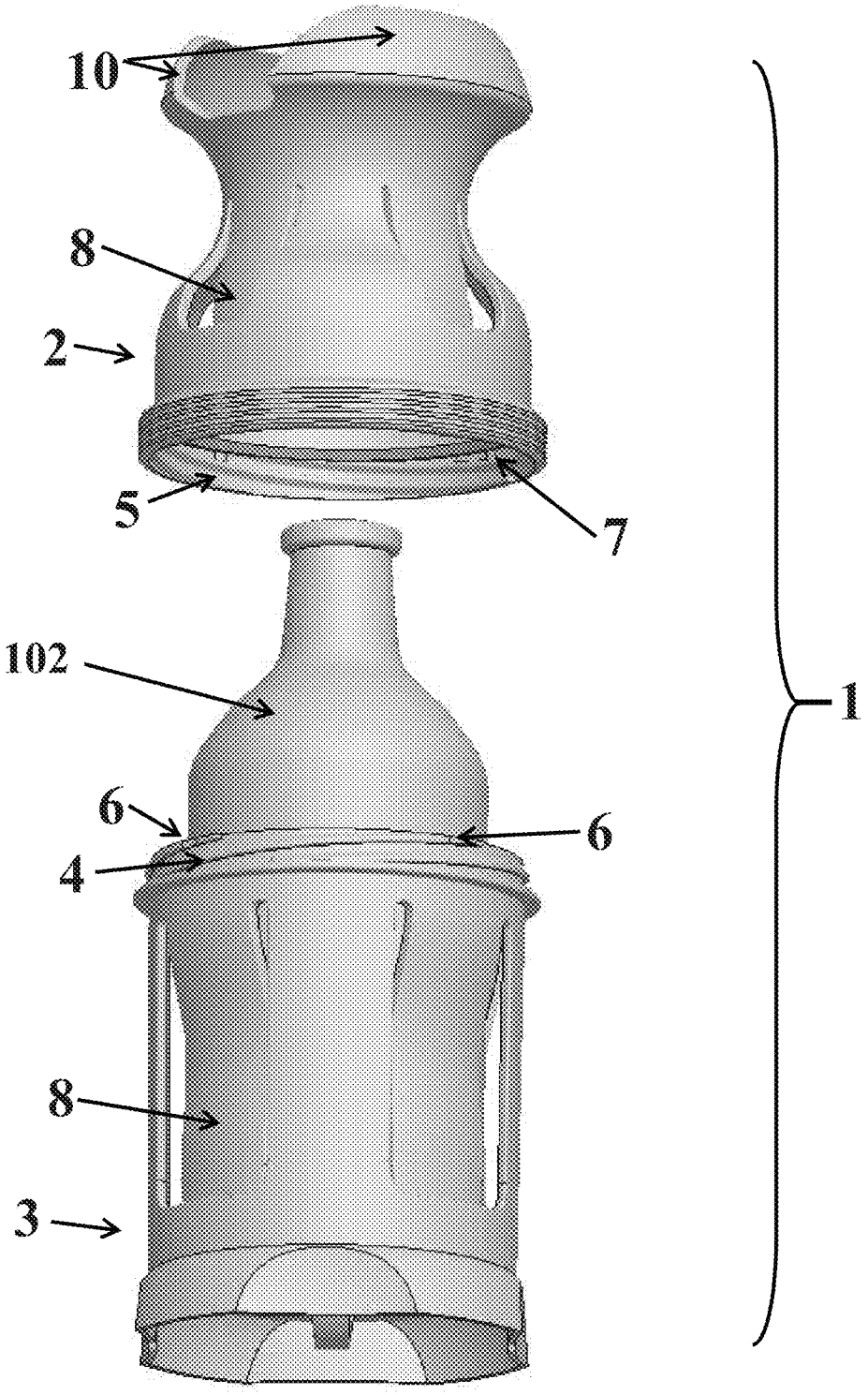
FIG. 4 is a profile view of a first (top) and second (bottom) portion of an embodiment of a container, with a glass bottle contained therein.

In some embodiments, the portions may be coupled together. Portions may be coupled using a coupling mechanism including, but not limited to threads, locking mechanisms, slide lock mechanisms, snaps, snap fittings, buckles, slides, flush joints, any coupling mechanism known in the art or combinations thereof. As depicted in FIG. 4, portions 2, 3 may be coupled together using threads 4 and 5. In some embodiments, threads 4 may be on the first (top) part of the shell and threads 5 may be on the second (bottom) part of the shell. In another embodiment, threads 5 may be on the first (top) part of the shell and threads 4 may be on the second (bottom) part of the shell. In some embodiments, the portions may be coupled together using a combination of coupling mechanisms, for example, threads and a locking mechanism positioned on an exterior surface of the shell.

Figure 5:
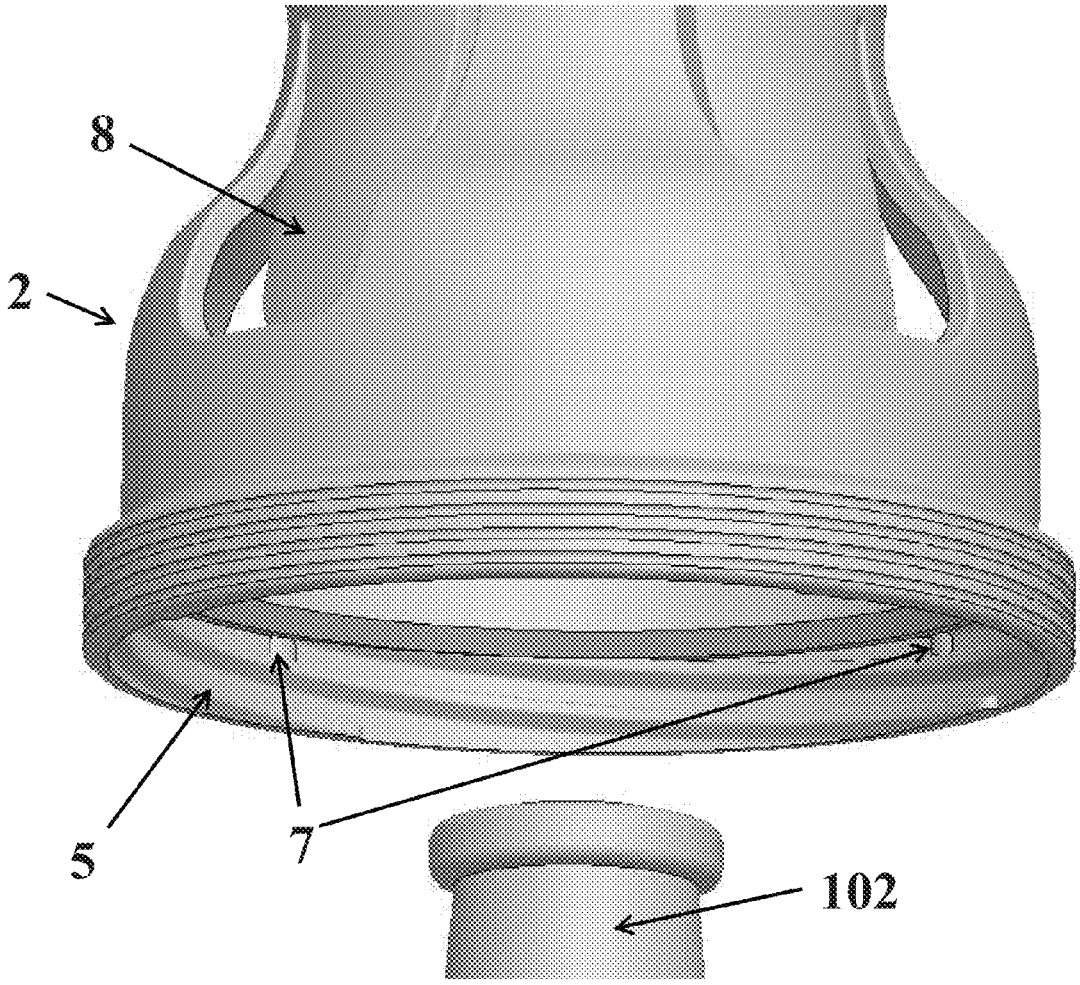
FIG. 5 is a side view of a first (top) portion of an embodiment of a container, with a glass bottle shown below.
Figure 5A:
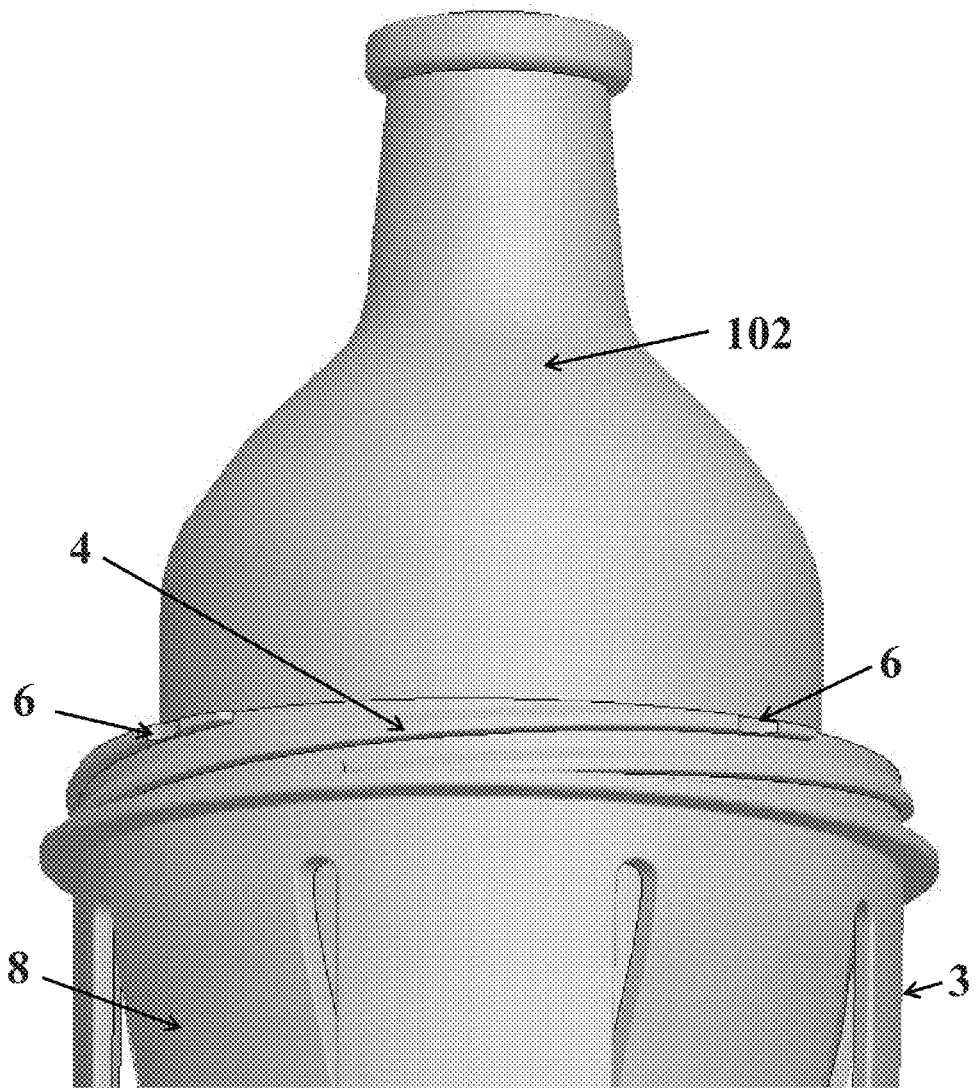
FIG. 5A is a side view of a second (bottom) portion of an embodiment of a container, with a glass bottle contained therein.

As shown in FIG. 5A, threads 4 may include indentations 6 to allow for securely locking the portions of the shell. An embodiment of a shell may include indentations in the threads spaced equally around the circumference of the shell (i.e. 12 o'clock, 3 o'clock, 6 o'clock, and 9 o'clock). Some embodiments may include alternative placements and numbers of indentations.

As shown in FIG. 5, some embodiments may include one or more protuberances 7, such as nubs or the like, positioned proximate threads 5. Protuberances 7 may be positioned such that they begin to engage with indentations 6 at a distance of about 0.5 mm to about 3 mm from complete closure of the portions of the shell. In an embodiment, protuberances 7 may begin to engage with indentations 6 at a distance of about 1 mm to about 2 mm. In some embodiments, other appropriate engagement distances may be used. The indentations and protuberances may include different contour geometries (e.g. angled, semi-cylindrical, etc) in order to match one another and provide a permanent or temporary lock of the portions of the shell.

In some embodiments, as shown in FIGS. 4, 5 and 5A, indentations may be positioned on second portion 3 of shell 1 such that the indentations correspond to the positions of protuberances placed on first portion 2 of shell 1. For example, indentations may be positioned on the threads located on the external threads (i.e., male threads) of the shell and protuberances may be positioned at corresponding locations on the internal threads (i.e., female threads) of the shell. Thus, some embodiments may include multiple coupling mechanisms to couple the portions together.

In some embodiments, the external threads are on the second portion (bottom) of the shell and the internal threads are on the first portion (top) of the shell. In other embodiments, the internal threads are on the second portion (bottom) of the shell and the external threads are on the first portion (top) of the shell.

In an embodiment, portions of the energy absorbing container may include one or more projections emanating from the shell. In some embodiments the projections may be integral to the shell of the energy absorbing container. As shown in FIG. 4, projections 8 may be cut out from shell 1 and project inward toward the center of shell 1. In some embodiments, projections positioned in different portions of the shell may have different geometries. The projections may be configured to secure a bottle placed within the energy absorbing container. In some embodiments, the projections are configured to absorb energy generated during an impact.

Figure 5B:
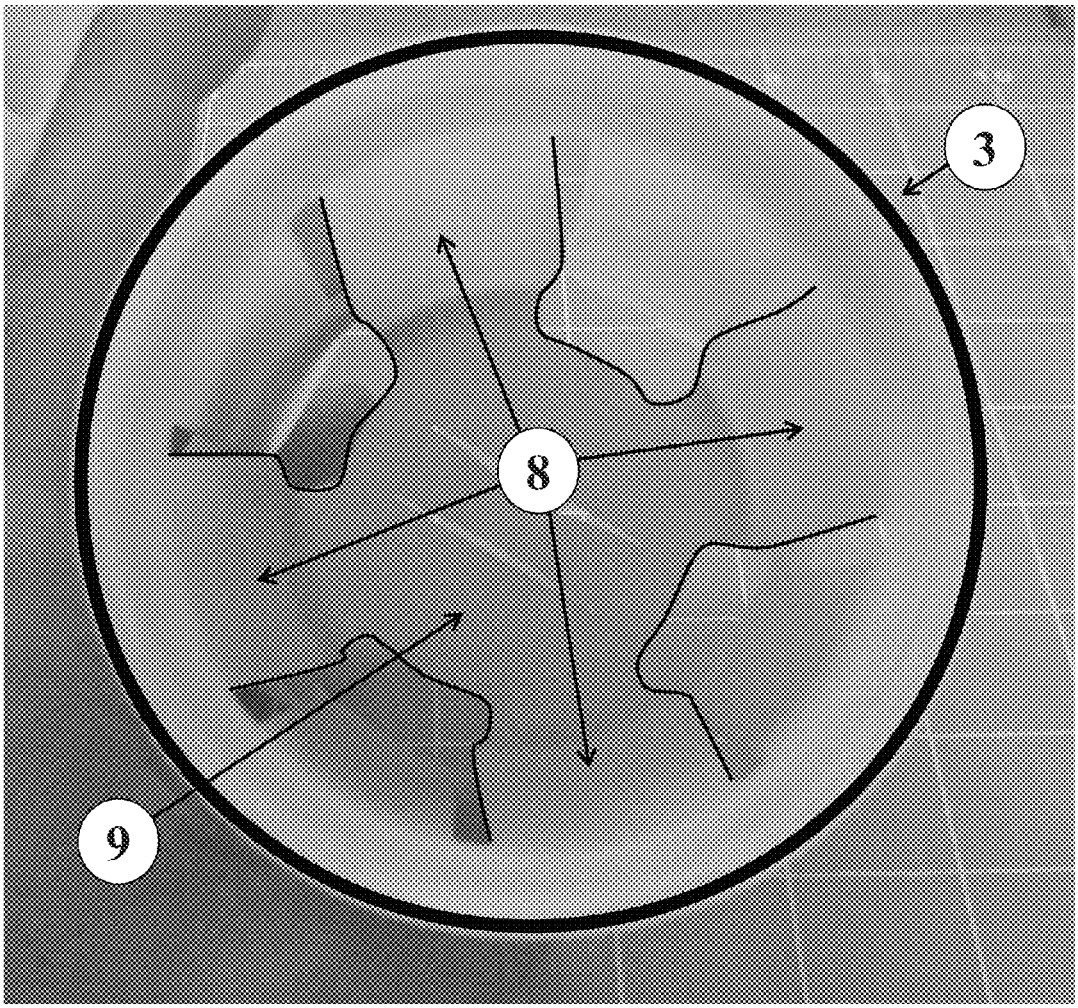
FIG. 5B is an above view of a second (bottom) portion of an embodiment of a container, emphasizing a "basket" structure.

Projections may have varied geometries including, but not limited to tabs, petals, ribs, or any geometry capable of securing the bottle in the energy absorbing container. For example, FIG. 5 depicts projections 8 having a tab configuration positioned on top portion 2 of shell 1. As shown in FIG. 5B, projections 8 positioned on bottom portion 3 of shell 1 may extend from opposite sides of the shell toward an end of the shell where the projections converge to form support structure 9. In some embodiments, the support structure may be configured in a basket-like configuration as shown in FIG. 5B. Support structure 9 may be configured to secure a bottle in energy absorbing container. In some embodiments, both the top and bottom portions may include support structures formed from projections emanating from the shell.

Figure 6:
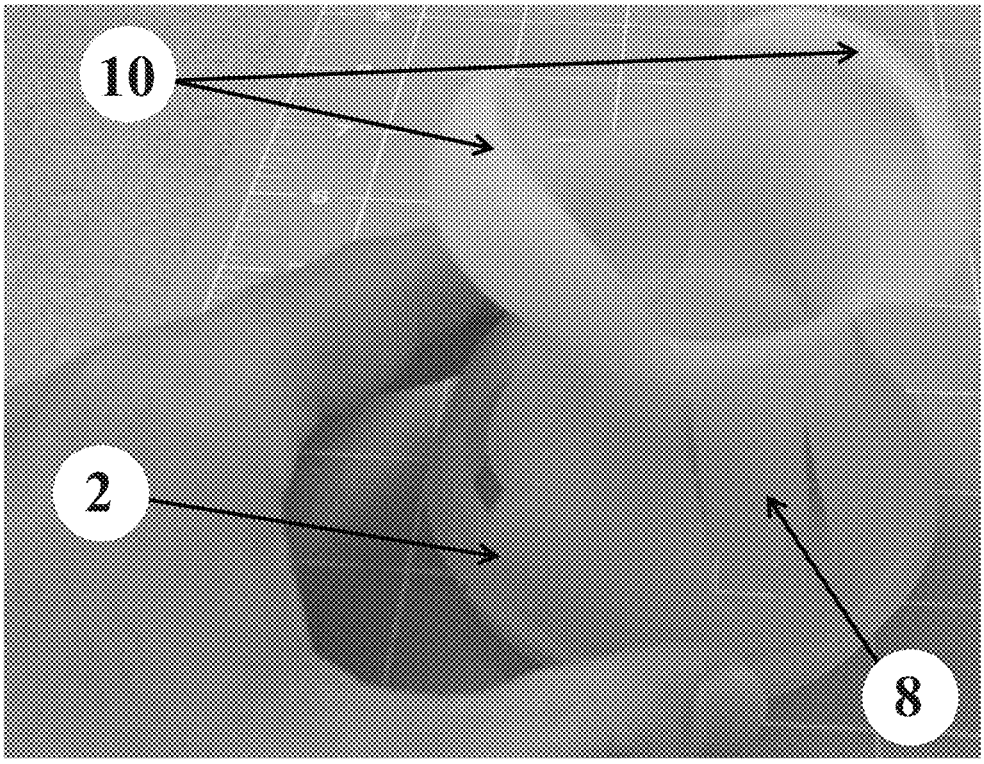
FIG. 6 is a perspective view of a first (top) portion of an embodiment of a container, shown next to a human hand.
Figure 6A:
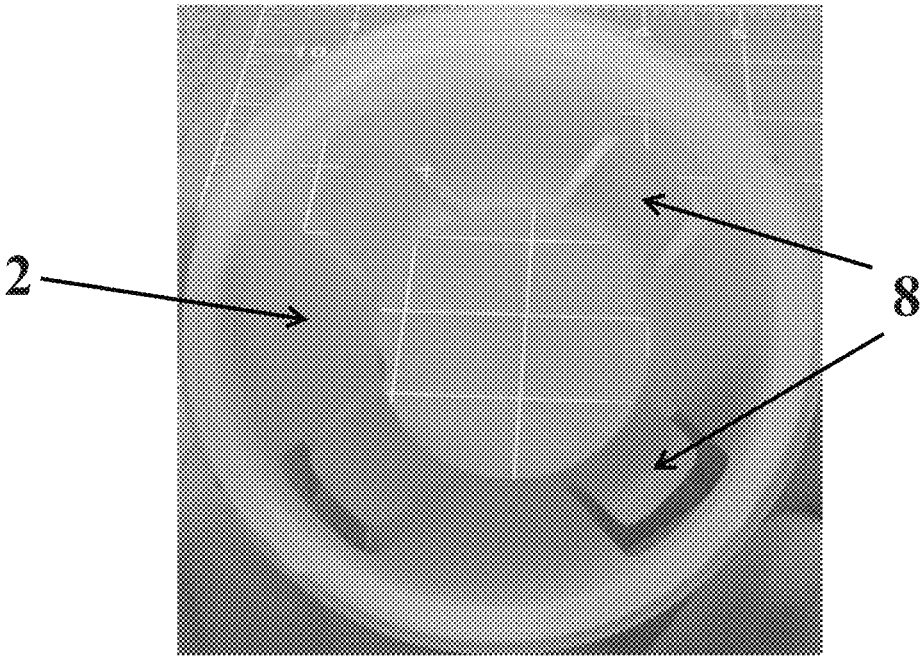
FIG. 6A is an underneath view of a first (top) portion of an embodiment of a container.

In some embodiments, the shell may be designed to conform to shape of a user's hands in order to enable ease of use. Shell 1 may be designed to be ergonomically friendly as shown in FIG. 6. In an embodiment, one or more portions may be designed to be ergonomically friendly. For example, top portion 2 may be include an ergonomic sections designed to conform to a user's hand. Some embodiments may include flared section 10 positioned on top portion 2 designed to protect the top of the bottle.

In some embodiments, energy absorbing containers may be made to conform to a variety of different bottle styles and/or sizes.

Some embodiments of the energy absorbing container may be configured to be reusable. In an embodiment, the energy absorbing container may be configured for single use (i.e., disposable).

Figure 7:
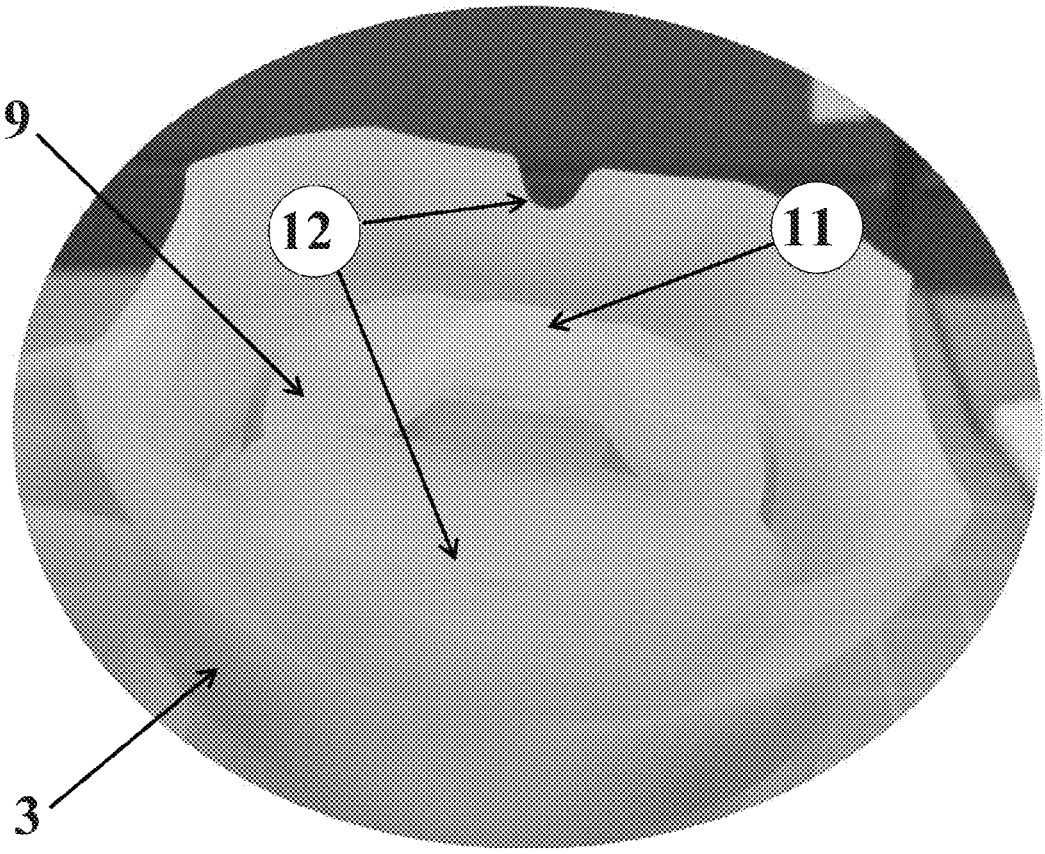
FIG. 7 is a perspective view of the bottom side of a second (bottom) portion of a container.

In an embodiment, a portion of the shell may include a suspension device which may allow the container to be suspended, for example, from a cord, hook, or thin rod. A rigid suspending member could inhibit the container from rotating, for example. As shown in FIG. 7, support structure 9 of portion 3 of shell 1 may have protrusion 11 capable of interacting with a cord, hook, or thin rod, allowing the container to be suspended. Also as shown in FIG. 7, protrusion 11 may be positioned between notches 12. Some embodiments may include multiple protrusions.

In one embodiment, notches 12 and protrusion 11 are arranged in a straight line, such that a cord, hook, thin rod, or rigid suspending member could both suspend and restrict the rotational movement of the container.

Figure 1:
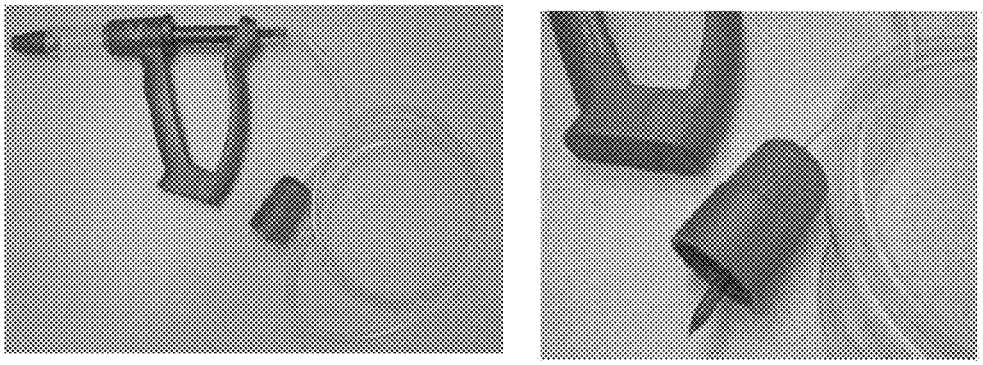
FIG. 1 is a profile view of an embodiment of a dosing gun injector.
Figure 8:
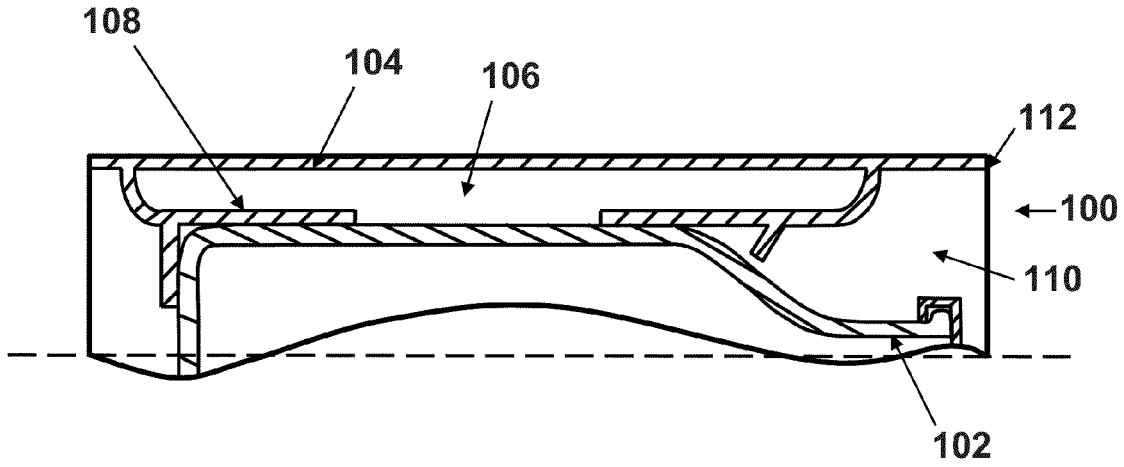
FIG. 8 is a cross-sectional view of an embodiment of a container.

FIG. 8 depicts a cross sectional view of a container 100 according to one embodiment. Container 100 may hold bottle 102. The container 100 is formed with an outer surface 104, which is separated from the bottle by a void space 106. The bottle 102 is secured in the container 100 through use of pliant energy absorbing members 108. In the example shown in FIG. 8, the energy absorbing members 108 are formed of the same material as the container 100, and may be formed integrally therewith. The energy absorbing members 108 deflect upon application of a force thereto. For example in a situation where the container 100 houses a bottle 102 and is dropped, the energy from the falling bottle is translated into the energy for deflecting the energy absorbing members 108. These energy absorbing members 108 also hold the bottle 102 against one another in order to prevent the bottle 102 from moving within the container 100. As shown in FIG. 8, the energy absorbing members are shaped so as to absorb energy of impact both when the container 100 is dropped on its side, as well as when dropped on either end of the container 100. The container 100 also includes extensions 112 which extend beyond the ends of the bottle 102 and form a void 110. The void 110 is useful in allowing the application of, for example, a dosing gun injector as shown in FIG. 1. The extensions 112 also help prevent impact to the ends of the bottle 102. One embodiment may be formed of a material that is essentially clear and allows for easy reading of a label placed on the bottle 102.

Figure 9:
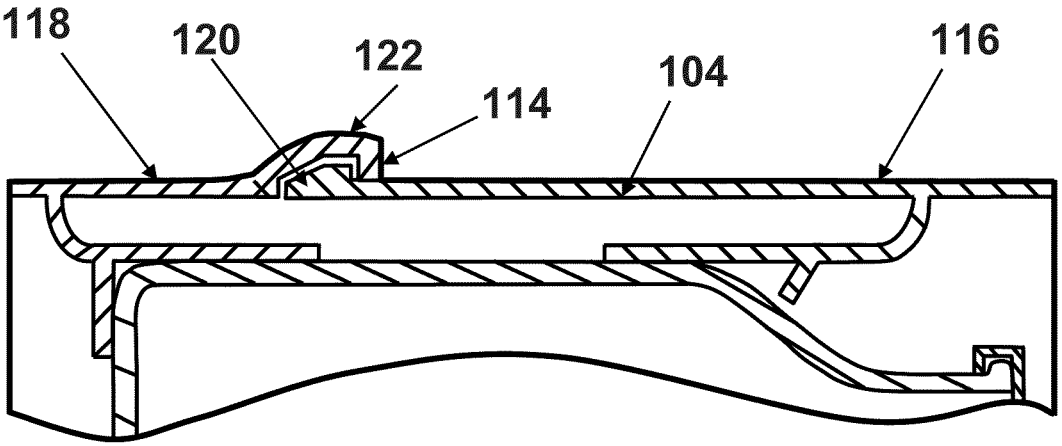
FIG. 9 is a cross-sectional view of an embodiment of a container.
Figure 9A:
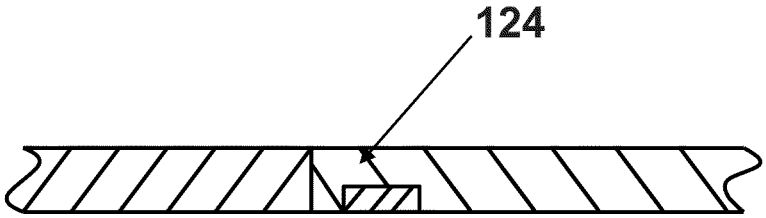
FIG. 9A is a cross-sectional view of a locking mechanism according to one embodiment.

A further embodiment is shown in FIGS. 9 and 9*a*. FIG. 9 shows a two-piece container which includes a lock mechanism 114. FIG. 9 shows a sliding lock mechanism 114 which allows a user to insert a first portion 116 of the container 100 into a second portion 118. An angled surface 120 of the sliding lock mechanism 114 allows for the first portion 116 of the container 100 to be displaced inward towards the bottle 102 and be secured by a receiving portion 122 of the sliding lock mechanism 114. The sliding lock mechanism 114 can be opened by application of force to the outer surface 104 of the first portion 116, which will cause the first portion 116 to deflect inward towards the bottle 102 and allow for the angled portion 120 of the sliding lock mechanism 114 to be removed from the receiving portion 122.

FIG. 9*a* shows an alternative to the sliding lock mechanism 114 shown in FIG. 9, a flush joint 124. The flush joint operates substantially similarly to the slide locking mechanism, in that it allows for the securing of a first portion 116 of the container 100 to the second portion 118. The flush joint 124 is comprised of two substantially identical tab and notch sections formed one on the first section 116 and second section 118 of the container 100. Again, the flush joint 124 can be opened by application of pressure to the outer surface 104 of the first portion 116 of the container 100, which deflects the tab of the first portion 116 out of the notch of the second portion and simultaneously the tab of the second portion 118 from the notch of the first portion 116. As a result the first portion 116 can be separated from the second portion 114 of the container 100.

Figure 10:
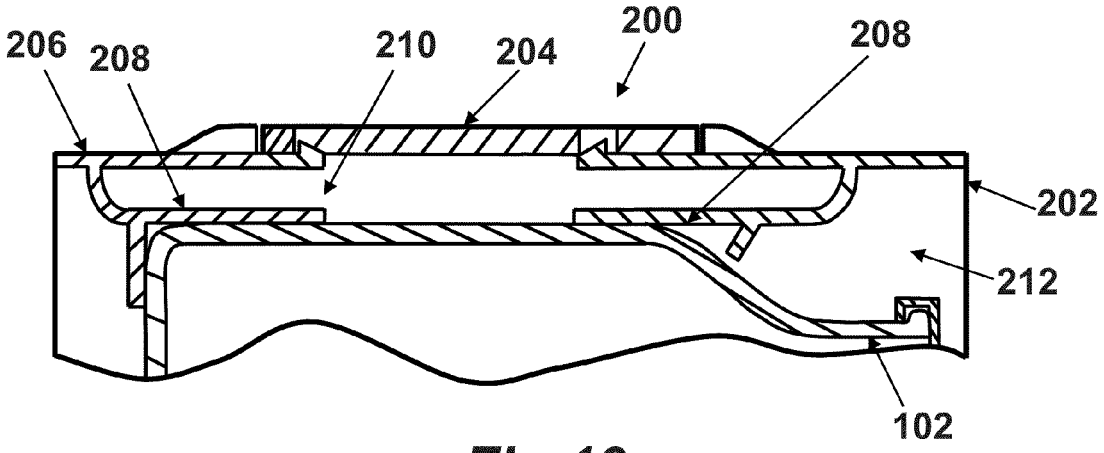
FIG. 10 is a cross-sectional view of an embodiment of a container.

Another embodiment is shown in FIG. 10, a three-part container 200. The three-part container 200 includes a top end cap 202, which substantially conforms with and supports a top portion of the bottle 102. The three-part container also includes a cylindrical sleeve 204, which surrounds the bottle 102. Finally, the three-part container also includes a bottom end cap 206, which substantially conforms with and supports a bottom portion of the bottle 102.

The cylindrical sleeve according to one aspect of the invention is extruded and then has a locking mechanism such as a slide lock mechanism machined into the sleeve. Another aspect of the invention is that the end caps 202 and 206 are molded to include energy absorbing or shock absorbing members 208. As with the embodiment shown in FIG. 8, the example shown in FIG. 10 includes a void space 210 separating the inner surface of the sleeve 204 from the bottle 102. Similarly, the container 200 includes a void 212, which protects the top portion of the bottle 102 and allows for access to the bottle 102 by either a syringe or a dose gun injector.

Figure 11:
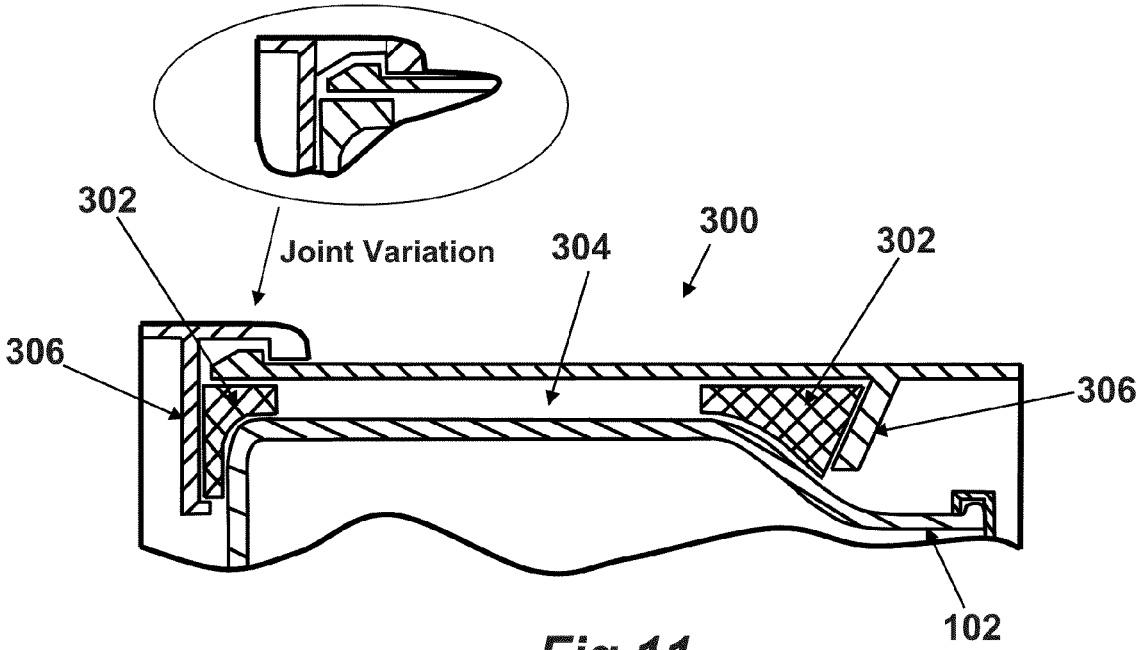
FIG. 11 is a cross-sectional view of an embodiment of a container.

An embodiment is shown in FIG. 11 in which depicts a second two piece container 300. The container 300 is similar to that shown in FIG. 9, however, the energy absorbing members 108, have been replaced with cushioning members 302, made of for example Styrofoam. Other materials could also be used to cushion the bottle 102 stored within the container 300. Like the energy absorbing members, the cushioning members 302 isolate the bottle 102 from the container 300 and create a void 304. The cushioning members 302 also secure the bottle 102 within the container 300 and prevent it from moving around. The cushioning members 302 may be held in place by supports 306.

Figure 12:
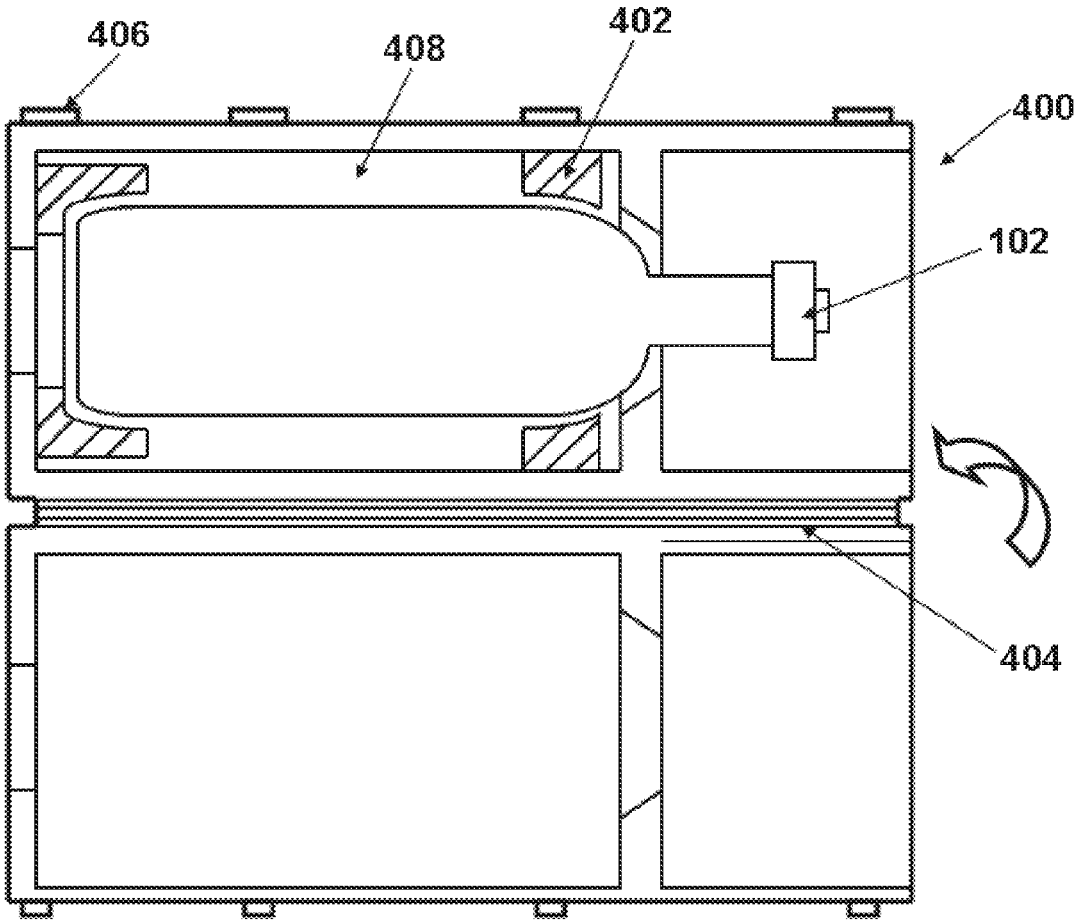
FIG. 12 is a cross-sectional top view of an embodiment of a container having a hinge.
Figure 13:
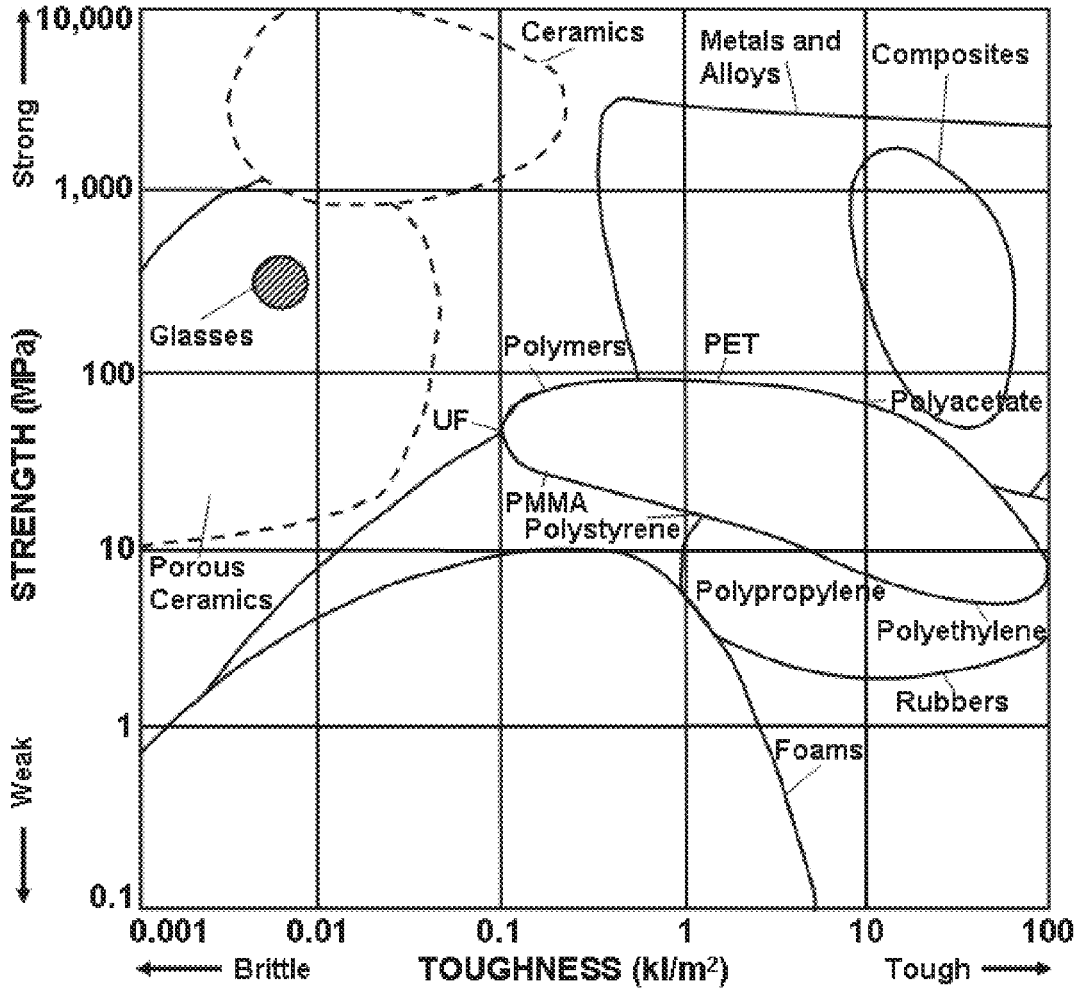
FIG. 13 is a plot of toughness v. strength of a variety of materials usable with one or more aspects of the present invention.

An embodiment is depicted in FIG. 12. Container 400 shown in FIG. 12 is a single piece having two halves joined by a hinge 404. The container 400 includes cushioning members 402, which isolate the bottle 102 from the container 400, and create a void 408 between the container 400 and the bottle 102. As shown, the container 400 is in the open position. The hinge 404 allows the two halves of the container to be folded onto one another to fully enclose the bottle 102. Once enclosed, closure devices 406, located on the edge of the two halves which are brought together to enclose the bottle 102, may provide a securing means for locking the bottle 102 in the container 400 and inhibiting or preventing accidental opening. One of skill in the art will appreciate that any number of different closure devices 406 could be used including, but not limited to snaps, buckles, slides, hook and loop fasteners, other closure devices known in the art and/or combinations thereof. Additionally, one of skill in the art will appreciate that while shown in FIG. 12 using the cushioning members 402, energy absorbing members as shown in FIG. 8 could also be used without departing form the teachings of the present invention. The one-piece construction as shown in FIG. 12 has the additional benefit that such a device lends itself to thermal forming methods which may help reduce machining and production costs.

Figure 14:
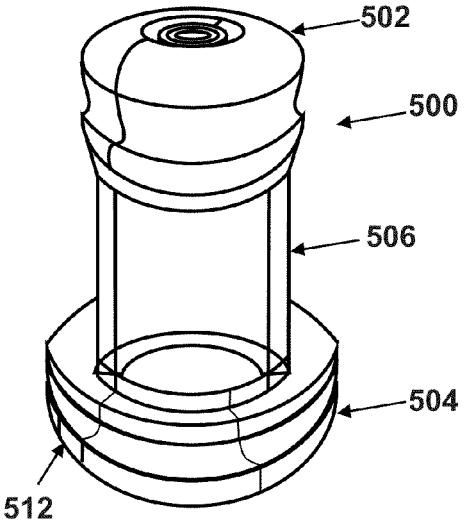
FIG. 14 is a perspective view of an embodiment of a container.
Figure 15:
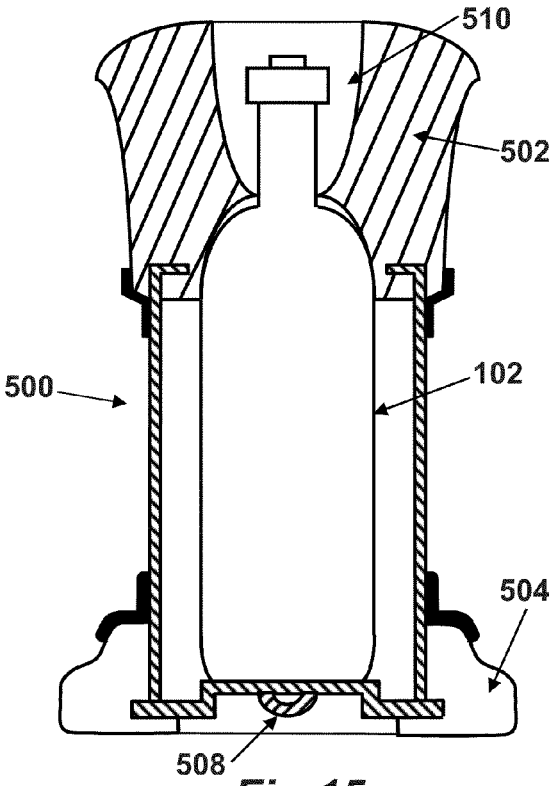
FIG. 15 is a cross-sectional view of an embodiment of a container.

Additional embodiments are depicted in FIGS. 14-23. FIGS. 14 and 15 depict a container 500 having molded top and bottom caps 502 and 504. These molded top and bottom caps act as cushioning member to absorb energy generated from impact to either end of the container 500. The molded caps 502 and 504 may be formed for example from Styrofoam. In addition, the molded caps hold the bottle 102 securely in place and substantially prevent its movement within the container 500. The container 500 also includes a clear or substantially clear cylindrical lens 506. The cylindrical lens 506 may be formed of a relatively hard plastic such as acrylic, and allows for a user to see the bottle 102 housed within the container 500. The container 500 also includes a void 510, which allows for access to the bottle 102 by a syringe or dosing gun injector. Another aspect of the container 500 is a hanging point 508, which allows the user to suspend the container 500 from a hook to prevent the injection of air when used, as discussed above. Yet a further aspect of the container 500 is one or more flats 512 formed on the sides of the end cap 504. These flats prevent the container 500 from rolling when placed on a flat surface. One of skill in the art will appreciate that such flats may also be formed on the end cap 502.

Figure 16:
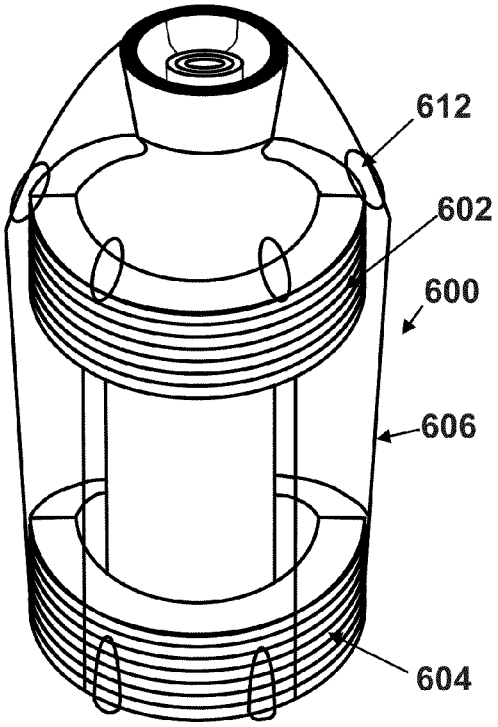
FIG. 16 is a perspective view of an embodiment of a container.
Figure 17:
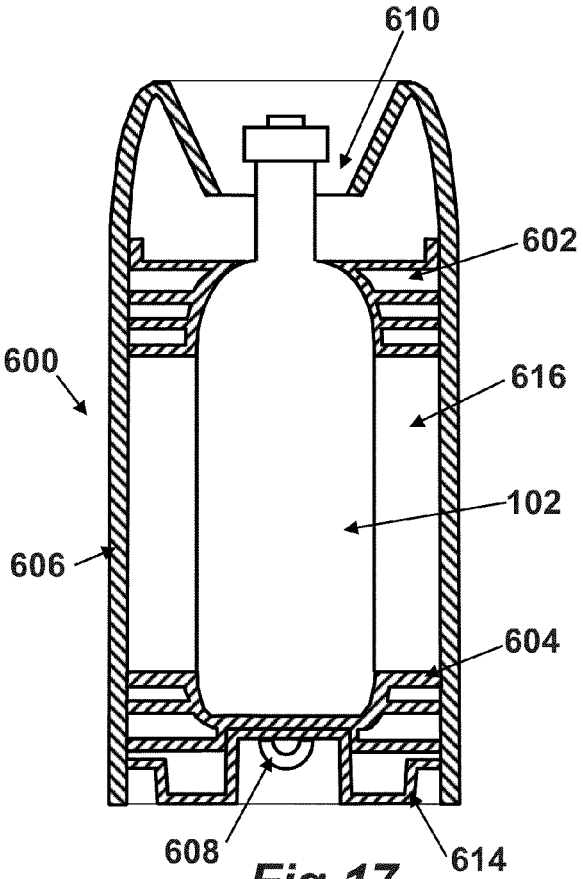
FIG. 17 is a cross-sectional view of an embodiment of a container.

Another embodiment is shown in FIGS. 16 and 17 where container 600 is depicted. The container 600 includes bumpers or cushioning members 602 and 604, which surround a bottle 102, and are themselves encased in a shell 604. As shown in FIG. 17, the bottle 102 is held by and against the cushioning members 602 and 604. The cushioning members may be formed of an elastomeric material such rubber or of a molded foam such as Styrofoam. The cushioning members 602 and 604 also isolate the bottle 102 from the shell 606 of the container 600. A bottom cover 614 prevents the bottle 102 from falling out the bottom of the container 600, and may be press fit or screwed into the container 600. A void 610 is located at the top of the container 600 to allow for access to the bottle by a syringe or dosing gun injector. As with the device shown in FIGS. 14 and 15 the aspect of the invention shown in FIGS. 11 and 12 also has a hanging point 608 allowing a user to suspend the container 600. The shell of the container may also include bumps 612 which prevent the container from rolling when placed on its side.

Figure 18:
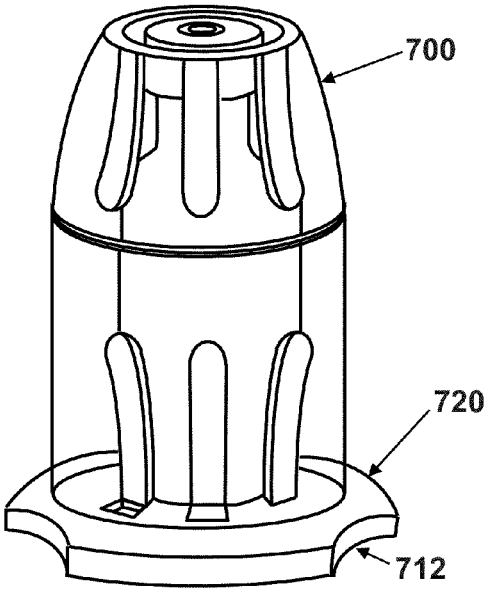
FIG. 18 is a perspective view of an embodiment of a container.
Figure 19:
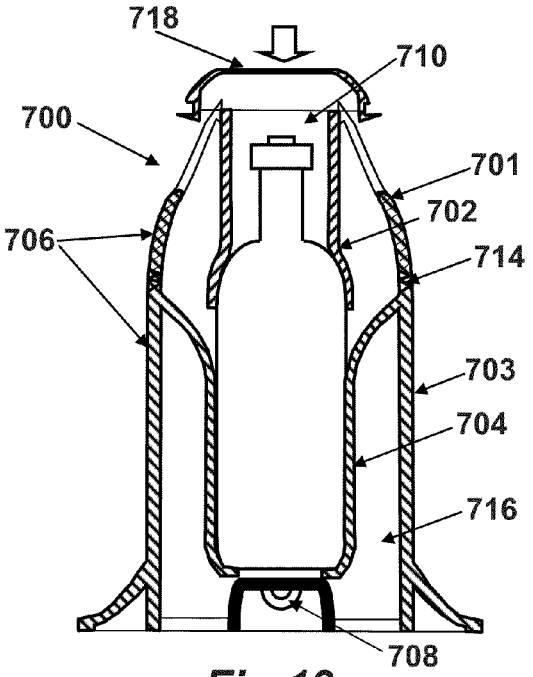
FIG. 19 is a cross-sectional view of an embodiment of a container.

An embodiment is depicted in FIGS. 18 and 19 showing a container 700. The container 700 has a shell 706 formed of a top portion 701 having ribs 702 for absorbing impact loads and for supporting the bottle 102. The container 700 is also formed of a bottom portion 703 having ribs 704 also for absorbing impact loads and for supporting the bottle 102. The top and bottom portions 701 and 703 may be joined for example by threads 714. Alternative means for joining the top and bottom portions such a snaps, clasps, etc., will be readily apparent to those of skill in the art. The ribs 702 and 704 isolate the bottle 102 from the shell 706 and create a void 716 therebetween. A further void 710 is formed in the top portion 701 to allow for access for syringes or dosing gun injectors by the user. An embodiment of the device shown in FIGS. 18 and 19 is a cover 718, which prevents debris and dirt from contaminating the container 700 or the bottle 102. As with the device shown in FIGS. 14 and 15 the aspect of the invention shown in FIGS. 18 and 19 also has a hanging point 708 allowing a user to suspend the container 700. The container 700 also may include divots 712 which prevent the container 700 from rolling when placed on a flat surface. A base 720, having a diameter greater than the diameter of the shell 706 may also be included to increase the stability of the container 700 when placed in an upright position. The entire container 700 may be formed of a single type of plastic. Alternatively, the ribs 702 and 704 may be formed of a second type of plastic and inserted into the container 700.

Figure 20:
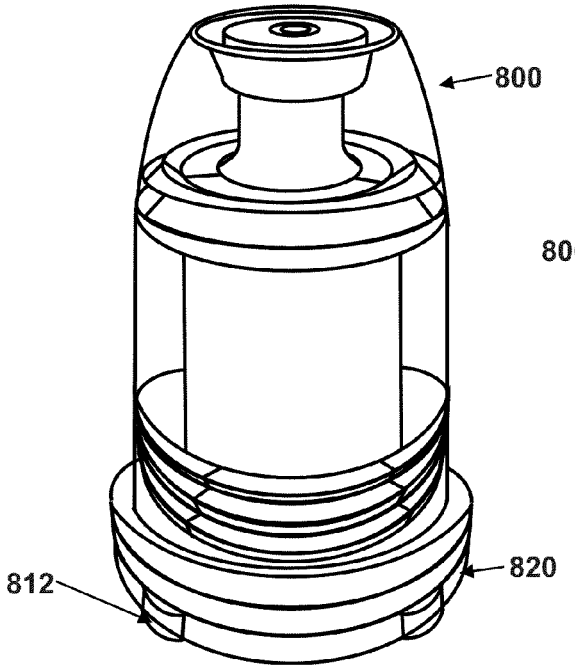
FIG. 20 is a perspective view of an embodiment of a container.
Figure 21:
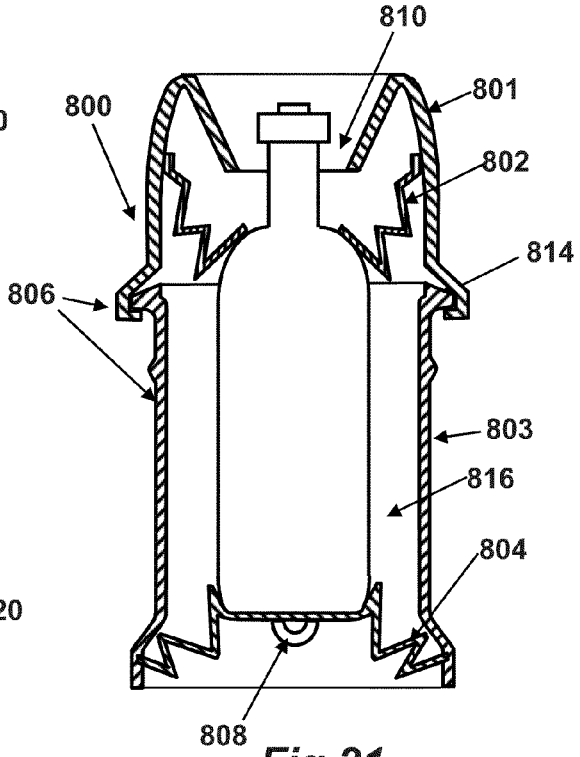
FIG. 21 is a cross-sectional view of a container.

Another embodiment is shown in FIGS. 20 and 21 depicting a container 800. The container 800 is similar to the container 700 shown in FIGS. 18 and 19, having a top portion 801 and bottom portion 803 each containing an energy absorbing bellows 802 and 804 respectively. The bellows 802 and 804 as shown are molded into the bellows form and then attached to the inside of the shell 806, for example by spin welding. The bellows 802 and 804 isolate the bottle 102 from the shell 806 and create a void 816 and act to absorb impact energy. The top portion 801 and bottom portion 803 are connectable for example by a snap fit closure 814. Alternate closure means are considered within the scope of the present invention. The container 800 also includes hanging means 808, and a void 810 is formed in the top portion 801 to allow access for syringes and dosing gun injectors. The container 800 may also include an anti-roll feature 812 to prevent rolling of the container 800 when placed on a flat surface as well as a base 820 having a wider diameter than the shell 806 for increased stability when placed in the upright position.

Figure 22:
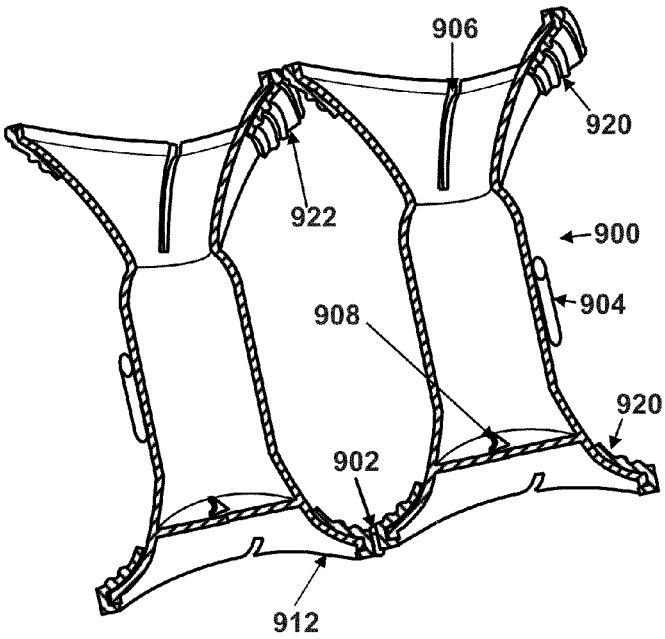
FIG. 22 is a perspective view of a container.
Figure 23:
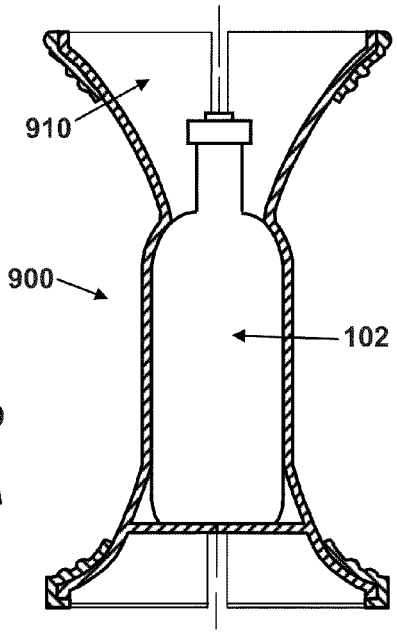
FIG. 23 is a cross-sectional view of a container.

An embodiment showing the use of a hinge 902 as discussed above is shown in FIGS. 22 and 23 depicting container 900. The container 900 includes a snap fit closure 904, and may also include a snap fit hanging means 908 which assist in ensuring secure closure of the container 900. The container 900 also includes bell shaped extensions 920 on both top and bottom ends of the container. The bell shaped extensions 920 act as energy absorbing means for absorbing impact loads when the container 900 is dropped. To assist in absorbing energy from impact the bell shaped extensions 920 contain one or more slots 906 cut into the bell shaped extension. These slots 906 allow at least a portion of the bell shaped extension 920 to deflect upon impact and further cushion the bottle 102 housed within the container 900. The bell shaped extensions may also include an overmold portion 922 of greater thickness than the rest of the bell shaped extension, which provides for greater strength and resistance to deflection, thus providing greater cushioning effect for the bottle 102. Also, as shown in FIG. 22, flats 912 may also be included in the container 900 to assist in resisting rolling of the container when placed on a flat surface.

A variety of materials may be used in conjunction with the components of the containers described herein. The materials can be extruded, machined, or worked by a variety of means so as to provided sleeves and caps, which may be attached to one another by a variety of means including adhesives, snaps, hook and loop fastening, threads, and other attachments means known to those of skill in the art. Among the materials useable with the present invention are hard plastics such as acrylic, for the shell or the cylindrical lens other materials could also be used such as polyethylene terephthalate (PET), polyvinyl chloride (PVC), polypropylene (PP), ABS plastics, Nylon, polybutylene terephthalate (PBT), polyethylene, such as High Density Polyethylene (HDPE), High Density Polypropylene (HDPP), polycarbonate, polystyrene such as high impact polystyrene (HIP), thermoplastic olefins (TPO's), polyesters, polyurethanes (PU), polyamides, and others. Examples of such additional plastics include those regularly used in the automotive industry for use in the manufacture of plastic parts including bumpers. According to the 2001 Automotive Plastics Report, published by Market Search, Inc., the most commonly used plastics are shown below:

TABLE 1

| Polymer | 1996 | 2001 | 2006 | 2011 |
|---|---|---|---|---|
| ABS | 201.8 | 173.5 | 142.8 | 116.8 |
| Nylon (PA) | 300.8 | 341.5 | 406.4 | 494.2 |
| Polycarbonate (PC) | 87.5 | 84.9 | 93.7 | 106.6 |
| Polyester (TP) | 133.0 | 129.2 | 144.0 | 161.1 |
| Polyester (TS) | 234.5 | 186.0 | 260.3 | 384.7 |
| Polyethylene (PE) | 365.6 | 437.2 | 509.0 | 587.5 |
| Polypropylene (PP) | 642.5 | 681.9 | 767.4 | 919.2 |
| Polypropylene (EDPM) | 157.9 | 375.1 | 436.0 | 509.7 |
| Polyurethane (PUR) | 831.4 | 792.5 | 914.2 | 1,123.2 |
| Polyvinylchloride (PVC) | 381.5 | 390.0 | 403.1 | 412.0 |
| Total | 5332.5 | 5592.8 | 6082.9 | 6,826 |

2001 *Automotive Plastics Report, published by Market Search, Inc*. This report is available at the plastics-car.org website.

In addition, the plastics used for the sleeve may be made of blends of two or more of the above-identified materials.

Foams for use with the instant invention include polystyrene foam such as Styrofoam, cellular foam such as PORON®, pure gum foam rubber, silicone foam, neoprene foam, polypropylene EPDM foam, polyethylene foam, polyurethane and others. Elastomeric materials include SANTOPRENE™, Silicone, NEOPRENE, Buna-N and others. One further alternative to foam materials are the use of air, liquid, or gel filled pillows made of for example polyethylene pr polypropylene flexible plastics.

Figure 1A:
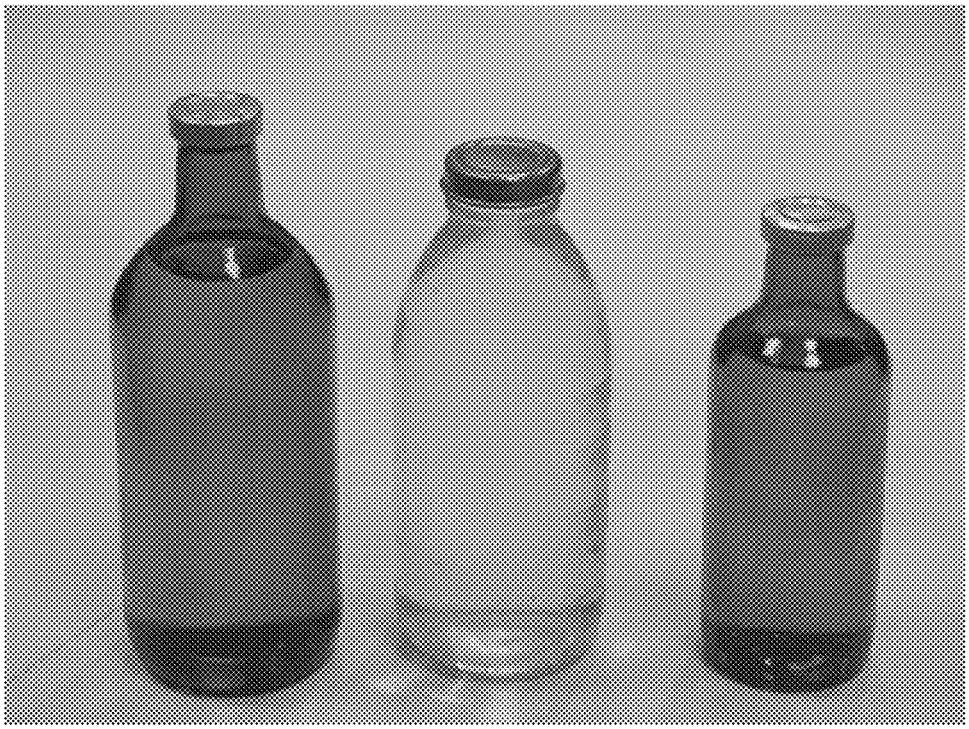
FIG. 1A is a profile view of bottles which may be used with the present invention.
Figure 2:
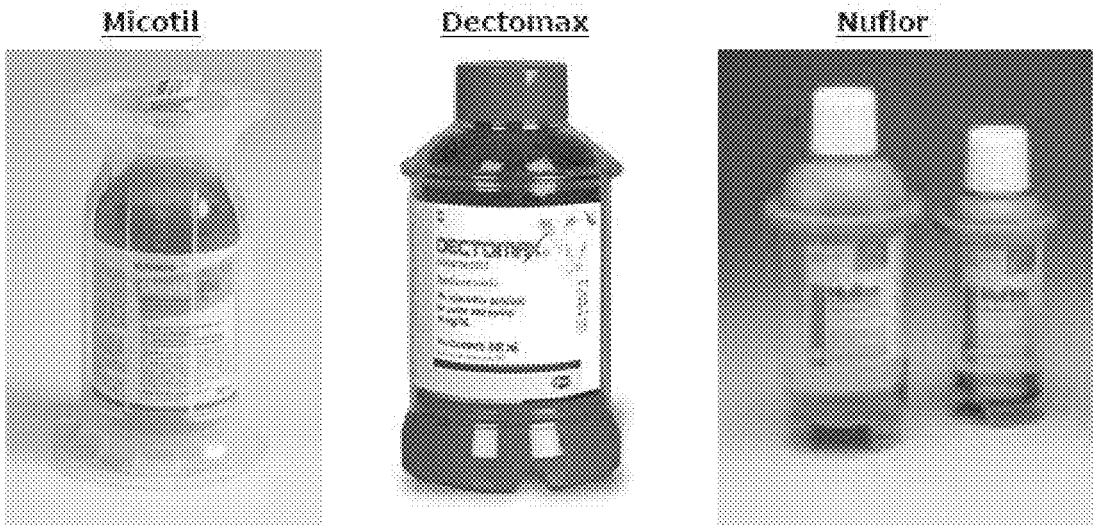
FIG. 2 is a profile view of a known protective cover.

In order to develop a container for a glass bottle that inhibits or prevents breakage and addresses one or more of the embodiments described above, tests were undertaken to determine the properties of a glass container in various states and the stresses such a container will withstand without breaking. In a first test, a filled unprotected 250 ml bottle of the type shown in FIG. 1A having an approximate thickness of between 1/16 to 1/8 of an inch (approximately 0.16-0.32 cm) was tested by dropping it flat against a hard surface, a concrete floor. It was determined that a glass bottle will break if dropped from a height of about 18-22 inches (approximately 45-56 cm). However, if an edge bearing surface, such as a piece of angle iron is placed so that on impact the side of glass bottle impacts the edge of the angle iron at approximately its center point, a glass bottle will break when dropped at between 12 and 17 inches (approximately 30-43 cm).

A second test was conducted to determine whether the use of a simple polypropylene sleeve would provide sufficient protection to prevent breakage of the glass container. A plastic sleeve was place around a 500 ml bottle, having an approximate thickness of between 1/16 and 1/8 of an inch (approximately 0.16-0.32 cm). The sleeve was separated from the bottle by rigid plastic so that the outer diameter of the bottle and sleeve was about 3¼" (approximately 8.3 cm), and there was about 0.06" (approximately 0.15 cm) separating the polypropylene sleeve from the glass. The results were that the bottle failed a side impact on a level surface when dropped from about 24-30" (approximately 60-76 cm), however, a bottle so arranged in a polypropylene sleeve did survive drops of 36" (about 90 cm) when dropped on either end of the bottle and sleeve arrangement. Again, when dropped onto an edge bearing surface such as angle iron, the bottle suffered failure at heights of only 16-18" (approximately 40-45 cm).

A third test was undertaken wherein a glass bottle was placed in an extruded PVC sleeve. The sleeve has a thickness of about 0.08" (about 0.2 cm). The PVC sleeve was fitted with machined polypropylene caps, which prevent the bottle from sliding out of the ends of the sleeve. The caps have a diameter of about 4.2 inches (about 10.7 cm), while the sleeve has a diameter of about 3.9 inches (about 9.9 cm). The bottle, when properly set in the sleeve is isolated from the inner wall of the sleeve by about 0.5" (about 1.2 cm). The sleeve is actually shorter than the length of the bottle, with the ends of the bottle resting against and being covered by the caps. Tests of this configuration confirmed that on flat surfaces such as concrete the height required for breakage of the bottle was at least 54" (about 137 cm). Similarly, when dropped onto an edge bearing surface, the breakage height was between 54 and 60" (about 137-152 cm).

Finally, although in some embodiments the sleeve may be substantially clear so that the contents may be examined without opening the sleeve, in others the sleeve may be tinted to prevent and/or inhibit the transmission of ultraviolet rays onto the treatment contained within the bottle. For example, the tinting may be of a color to reflect light energy such as white. In addition, it may be desirable that the end caps be made of a color or light orange such as white that reflects light energy so as to prevent the heating of the treatment contained therein.

Each document cited in this text ("application cited documents") and each document cited or referenced in each of the application cited documents, and any manufacturer's specifications or instructions for any products mentioned in this text and in any document incorporated into this text, are hereby incorporated herein by reference; and, technology in each of the documents incorporated herein by reference can be used in the practice of this invention.

It is noted that in this disclosure, terms such as "comprises", "comprised", "comprising", "contains", "containing" and the like can have the meaning attributed to them in U.S. Patent law; e.g., they can mean "includes", "included", "including" and the like. Terms such as "consisting essentially of" and "consists essentially of" have the meaning attributed to them in U.S. Patent law, e.g., they allow for the inclusion of additional ingredients or steps that do not detract from the novel or basic characteristics of the invention, i.e., they exclude additional unrecited ingredients or steps that detract from novel or basic characteristics of the invention, and they exclude ingredients or steps of the prior art, such as documents in the art that are cited herein or are incorporated by reference herein, especially as it is a goal of this document to define embodiments that are patentable, e.g., novel, non-obvious, inventive, over the prior art, e.g., over documents cited herein or incorporated by reference herein. And, the terms "consists of" and "consisting of" have the meaning ascribed to them in U.S. Patent law; namely, that these terms are closed ended.

Having thus described in detail embodiments of the present invention, it is to be understood that the invention defined by the appended claims is not to be limited to particular details set forth in the above description as many apparent variations thereof are possible without departing from the spirit or scope of the present invention.

What is claimed is:

1. An energy absorbing container comprising:

a shell formed of a plastic material;

eight or more pliant projections formed from at least one portion of the shell configured to secure a bottle stored within the container at a predetermined distance from the shell to inhibit movement of said bottle within the container; and an opening in the container configured to allow placement or removal of the bottle, and access thereto, in the container; and wherein the eight or more projections emanate from the shell, and extend from a first side of the shell to a second side of the shell such that a basket is formed configured to secure the bottle; and wherein the shell comprises at least one flared section configured to extend past the length of the bottle to protect the tops of bottles form impacts; and wherein the container is capable of standing freely on a flat surface; and the opening is configured to allow access to the bottle; and wherein the container has a hanging point allowing a user to suspend the container.

2. The energy absorbing container of claim 1, wherein the shell comprises two portions, a first portion and a second portion; and wherein at least some of the eight or more projections are tabs and are positioned on the first portion; and wherein the container is effective in preventing the breakage of a glass bottle stored within the container, when the container is dropped from a height of up to about 60 inches.

3. The energy absorbing container of claim 1, wherein the shell comprises:

a first portion;

a second portion configured to couple to the first portion; and wherein the eight or more projections are positioned on the second portion such that the projections emanate from the second portion and extend from a first side of the shell to a second side of the shell such that a basket is formed, the basket configured to secure the bottle.

4. The energy absorbing container of claim 2, wherein the first portion comprises threads and protuberances;

wherein the second portion comprises threads and indentations; and wherein the threads of the first portion are configured to engage the threads of the second portion such that the first portion and the second portion are coupled together, and wherein the protuberances of the first portion and the indentations of the second portion can be slidably aligned to lock the first and second portions together, thereby securing the bottle, and minimizing the risk that the first portion and the second portion will become separated when the container impacts a hard surface, wherein the first portion is configured to accommodate attachment of a dosing gun injector to the bottle, and wherein at least some of the eight or more projections are positioned in both the first portion and the second portion of the shell.

5. The energy absorbing container of claim 1, wherein the opening is configured to allow access to the bottle for connecting the bottle to a dosing gun.

6. The energy absorbing container of claim 1, wherein the projections are petals configured to flex in a direction essentially perpendicular to the bottle.

7. The energy absorbing container of claim 1, wherein the shell comprises a first portion and a second portion and wherein at least one of the eight or more projections is positioned in the first portion of the shell.

8. The energy absorbing container of claim 1, wherein the shell comprises a first portion and a second portion and wherein at least one of the eight or more projections is positioned in the second portion of the shell.

9. The energy absorbing container of claim 1, wherein the shell comprises a first portion and a second portion and wherein the first portion and the second portion are configured to couple together, and wherein the shell extends past the length of the bottle.

10. The energy absorbing container of claim 1, wherein the shell comprises:

a first portion of the shell comprising threads; and a second portion of the shell comprising threads; and wherein the threads of the first portion are configured to engage the threads of the second portion such that the first portion and the second portion are coupled together.

11. The energy absorbing container of claim 1, wherein the shell comprises a first portion and a second portion coupled together using a slide locking mechanism.

12. The energy absorbing container of claim 1, wherein the shell comprises a first portion and a second portion coupled together using a flush joint.

13. The energy absorbing container of claim 1, wherein the shell has a securing means for locking the bottle in the container and inhibiting or preventing accidental opening of the container.

14. The energy absorbing container of claim 1, further comprising a removable base.

15. The energy absorbing container of claim 1, wherein the eight or more projections isolate the bottle from the shell.

* * * * *